US007361224B2

(12) United States Patent
Trakowski et al.

(10) Patent No.: US 7,361,224 B2
(45) Date of Patent: Apr. 22, 2008

(54) DEVICE FOR HOT DIP COATING METAL STRANDS

(75) Inventors: Walter Trakowski, Duisburg (DE); Olaf Norman Jepsen, Siegen (DE); Eckart Schunk, Düsseldorf (DE); Klaus Frommann, Düsseldorf (DE); Rolf Brisberger, Issum (DE); Holger Behrens, Erkrath (DE); Michael Zielenbach, Siegen (DE)

(73) Assignee: SMS Demag AG, Düsseldorf (DE)

( * ) Notice: Subject to any disclaimer, the term of this patent is extended or adjusted under 35 U.S.C. 154(b) by 86 days.

(21) Appl. No.: 10/507,269

(22) PCT Filed: Feb. 20, 2003

(86) PCT No.: PCT/EP03/01701

§ 371 (c)(1),
(2), (4) Date: Apr. 4, 2005

(87) PCT Pub. No.: WO03/076680

PCT Pub. Date: Sep. 18, 2003

(65) Prior Publication Data

US 2005/0172893 A1 Aug. 11, 2005

(30) Foreign Application Priority Data

Mar. 9, 2002 (DE) ..... 102 10 430

(51) Int. Cl.
*B05C 3/02* (2006.01)

(52) U.S. Cl. ..... 118/405; 118/419

(58) Field of Classification Search ..... 118/419, 118/405, 423; 427/431, 434.6; 222/591, 222/597, 599, 601; 266/234; 164/467, 466, 164/146.1

See application file for complete search history.

(56) References Cited

U.S. PATENT DOCUMENTS

| | | | | |
|---|---|---|---|---|
| 4,082,207 | A * | 4/1978 | Garnier et al. | 222/594 |
| 4,450,892 | A * | 5/1984 | Heinemann et al. | 164/467 |
| 4,842,170 | A * | 6/1989 | Del Vecchio et al. | 222/594 |
| 5,765,730 | A * | 6/1998 | Richter | 222/590 |
| 5,965,210 | A * | 10/1999 | Tada et al. | 427/434.7 |
| 6,106,620 | A * | 8/2000 | Morrison et al. | 118/429 |
| 6,929,697 | B2 * | 8/2005 | Bergmann et al. | 118/419 |

* cited by examiner

*Primary Examiner*—Brenda A. Lamb
(74) *Attorney, Agent, or Firm*—Friedrich Kueffner

(57) ABSTRACT

The invention relates to a device for hot dip coating metal strands (1), particularly strip steel, in which the metal strand (1) can be vertically guided through a reservoir (3), which accommodates the molten coating metal (2), and though a guide channel (4) connected upstream therefrom. An electromagnetic inductor (5) is mounted in the area of the guide channel (4) and in order to retain the coating metal (2) inside the reservoir (3), can induce induction currents in the coating metal (2) by means of an electromagnetic blocking field. While interacting with the electromagnetic blocking field, said induction currents exert an electromagnetic force. In order to prevent an intense heating of the metal strand caused by the electromagnetic inductor, the invention provides that the inductor (5, 5*a*, 5*b*) is connected to electric power supply means (6) that supply the inductor with an alternating current whose frequency (f) is less than 500 Hz. In particular, a mains frequency of 50 Hz is intended.

7 Claims, 4 Drawing Sheets

DEVICE FOR HOT DIP COATING METAL STRANDS

BACKGROUND OF THE INVENTION

1. Field of Invention

The invention concerns a device for the hot dip coating of metal strands, especially steel strip, in which the metal strand can be guided vertically through a tank that contains the molten coating metal and through an upstream guide channel, wherein an electromagnetic inductor is installed in the area of the guide channel, which, for the purpose of retaining the coating metal in the tank by means of an electromagnetic blocking field, can induce induction currents in the coating metal, which, in interaction with the electromagnetic blocking field, exert an electromagnetic force.

2. Description of the Related Art

Conventional metal hot dip coating installations for metal strip have a high-maintenance section, namely, the coating tank and the fittings it contains. Before being coated, the surfaces of the metal strip must be cleaned of oxide residues and activated for bonding with the coating metal. For this reason, the strip surfaces are subjected to heat treatments in a reducing atmosphere before the coating operation is carried out. Since the oxide coatings are first removed by chemical or abrasive methods, the reducing heat treatment process activates the surfaces, so that after the heat treatment, they are present in a pure metallic state.

However, this activation of the strip surfaces increases their affinity for the surrounding atmospheric oxygen. To prevent the surface of the strip from being reexposed to atmospheric oxygen before the coating process, the strip is introduced into the hot dip coating bath from above in an immersion snout. Since the coating metal is present in the molten state, and since one would like to utilize gravity together with blowing devices to adjust the coating thickness, but the subsequent processes prohibit strip contact until the coating metal has completely solidified, the strip must be deflected in the vertical direction in the coating tank. This is accomplished with a roller that runs in the molten metal. This roller is subject to strong wear by the molten coating metal and is the cause of shutdowns and thus loss of production.

The desired low coating thicknesses of the coating metal, which vary in the micrometer range, place high demands on the quality of the strip surface. This means that the surfaces of the strip-guiding rollers must also be of high quality. Problems with these surfaces generally lead to defects in the surface of the strip. This is a further cause of frequent plant shutdowns.

In addition, previous hot dip coating systems have limiting values in their coating rates. These limiting values are related to the operation of the stripping jets, to the cooling processes of the metal strip passing through the system, and to the heat process for adjusting alloy coatings in the coating metal. As a result, the maximum rate is generally limited, and certain types of metal strip cannot be conveyed at the plant's maximum possible rate.

During the hot dip coating process, alloying operations for the bonding of the coating metal to the surface of the strip are carried out. The properties and thicknesses of the alloy coatings that form are strongly dependent on the temperature in the coating tank. For this reason, in many coating operations, although, of course, the coating metal must be maintained in a liquid state, the temperatures may not exceed certain limits. This conflicts with the desired effect of stripping the coating metal to adjust a certain coating thickness, since the viscosity of the coating metal necessary for the stripping operation increases with decreasing temperature and thus complicates the stripping operation.

To avoid the problems associated with rollers running in the molten coating metal, approaches have been proposed, in which a coating tank is used that is open at the bottom and has a guide channel in its lower section for guiding the strip vertically upward, and in which an electromagnetic seal is used to seal the open bottom of the tank. The production of the electromagnetic seal involves the use of electromagnetic inductors, which operate with electromagnetic alternating or traveling fields that seal the coating tank at the bottom by means of a repelling, pumping, or constricting effect.

A solution of this type is described, for example, in EP 0 673 444 B1. The solution described in JP 50[1975]-86,446 also provides for an electromagnetic seal for sealing the coating tank at the bottom.

Although this allows the coating of nonferromagnetic metal strip, problems arise in the coating of steel strip that is essentially ferromagnetic, because the strip is drawn to the walls of the channel by the ferromagnetism in the electromagnetic seals, and this damages the surface of the strip. Another problem that arises is that the coating metal is unacceptably heated by the inductive fields.

An unstable equilibrium exists with respect to the position of the ferromagnetic steel strip passing through the guide channel between two traveling-field inductors. The sum of the forces of magnetic attraction acting on the strip is zero only in the center of the guide channel. As soon as the steel strip is deflected from its center position, it draws closer to one of the two inductors and moves farther away from the other inductor. The reasons for this type of deflection may be simple flatness defects of the strip. Defects of this type could include any type of strip waviness in the direction of strip flow, viewed over the width of the strip (center buckles, quarter buckles, edge waviness, flutter, twist, crossbow, S-shape, etc.). The magnetic induction, which is responsible for the magnetic attraction, decreases in field strength with increasing distance from the inductor according to an exponential function. Therefore, the force of attraction similarly decreases with the square of the induction field strength with increasing distance from the inductor. This means that, when the strip is deflected in one direction, the force of attraction to one inductor increases exponentially, while the restoring force by the other inductor decreases exponentially. Both effects intensify by themselves, so that the equilibrium is unstable.

DE 195 35 854 A1 and DE 100 14 867 A1 offer approaches to the solution of this problem, i.e., the problem of more precise position control of the metal strand in the guide channel. According to the concepts disclosed there, the coils for inducing the electromagnetic traveling field are supplemented by correction coils, which are connected to an automatic control system and see to it that when the metal strip deviates from its center position, it is brought back into this position.

In the realization of this principle, i.e., the concept of the traveling field inductor with correction coils, it was found to be a disadvantage that the inductors for inducing the electromagnetic traveling field must have a relatively large overall height due to the required field strength and electric currents and the laminated cores needed for this. The height of the inductor is usually on the order of 600 mm. This has negative effects on the height of the column of liquid metal in the guide channel.

To avoid this problem, WO 96/03533 A1 describes a device of this general type, which uses an electromagnetic blocking field to hold back the coating material and in which only one induction coil is used. The overall height of the inductor is thus relatively small.

However, as the metal strand passes through the guide channel, a disadvantage that arises is that the strand experiences a strong ferromagnetic attraction to the walls of the guide channel. To prevent this, the blocking field inductors in this well-known installation are operated with alternating current with a frequency higher than 3 kHz. This reduces the ferromagnetic attraction to a very low level, but it cannot be completely avoided. Another disadvantage is that strong heating of the metal strand occurs as it passes through the guide channel.

SUMMARY OF THE INVENTION

Therefore, the objective of the invention is to further develop a device for the hot dip coating of metal strands of the type specified at the beginning in such a way that the specified disadvantages are overcome. In particular, the objective is thus to design an electromagnetic inductor that has a small overall height and yet does not cause strong heating of the metal strand.

In accordance with the invention, this objective is achieved by connecting the inductor to electric supply means that supplies the inductor with alternating current with a frequency that is less than 500 Hz, preferably a frequency that is less than 100 Hz, and especially a frequency of 50 Hz (standard power frequency).

This refinement makes it possible to achieve significant reduction of the heating of the metal strand as it passes through the guide channel, compared to the previously known solution. In addition, it is easier to guide the metal strand in the center of the guide channel, since the ferromagnetic attraction of the metal strand to the walls of the guide channel is significantly lower than in the previously known solution. Therefore, the selected design makes it possible to achieve the desired low overall height of the inductor.

In accordance with a refinement of the invention, the supply means supplies the inductor with single-phase alternating current.

It is advantageous for the inductor to have an induction coil on either side of the guide channel.

It was found to be especially advantageous if the device is equipped with means for guiding the metal strand in the guide channel. Various possibilities for this are conceivable.

In one refinement, the means for guiding the metal strand comprise at least one pair of guide rollers, which are preferably installed in the lower region of the guide channel or below the guide channel.

In accordance with an alternative (or possibly additive) embodiment, the means for guiding the metal strand comprise at least two correction coils for controlling the position of the metal strand in the guide channel in the direction normal to the surface of the metal strand. In this regard, the correction coils can be arranged at the same height as the induction coils, as viewed in the direction of movement of the metal strand. Good effectiveness of the inductor is obtained if the electromagnetic inductor has two grooves, which run parallel to each other, perpendicularly to the direction of movement of the metal strand and perpendicularly to the normal direction, for holding the induction coil and the correction coil. Control of the metal strand in the guide channel is facilitated if the correction coil mounted in the grooves is mounted closer to the metal strand than is the induction coil. More exact control can be achieved if the inductor has at least two correction coils arranged side by side in a row on either side of the metal strand.

Furthermore, means can be provided for supplying the correction coils with an alternating current that has the same phase as the current with which the induction coils are operated.

If position control of the metal strand in the guide channel by means of the aforesaid correction coils is envisaged, the position of the running steel strip can be detected by induction field sensors, which are operated with a weak measuring field of high frequency. For this purpose, a voltage of higher frequency with low power is superposed on the induction coils. The higher-frequency voltage has no effect on the seal; similarly, this does not produce any heating of the coating metal or steel strip. The higher-frequency induction can be filtered out from the powerful signal of the normal seal and then yields a signal proportional to the distance from the sensor. The position of the strip in the guide channel can be detected and controlled with this signal.

BRIEF DESCRIPTION OF THE DRAWING

Embodiments of the invention are illustrated in the drawings.

FIG. 1 shows the principle of the hot dip coating of a metal strand 1, especially a steel strip. The metal strand 1 that is to be coated enters the guide channel 4 of the coating system vertically from below. The guide channel 4 forms the lower end of a tank 3, which is filled with molten coating metal 2. The metal strand 1 is guided vertically upward in direction of movement "X". To prevent the molten coating metal 2 from being able to run out of the tank 3, an electromagnetic inductor 5 is installed in the area of the guide channel 4. It consists of two halves 5*a* and 5*b*, which are installed on either side of the metal strand 1. In the electromagnetic inductor 5, an electromagnetic blocking field is induced, which holds the molten coating metal 2 in the tank 3 and thus prevents it from running out.

The inductor 5 is supplied with single-phase alternating current by an electric supply means 6. The frequency "f" of the alternating current is below 500 Hz, and the use of standard power frequency, i.e., 50 or 60 Hz, is preferred.

Figure 1:
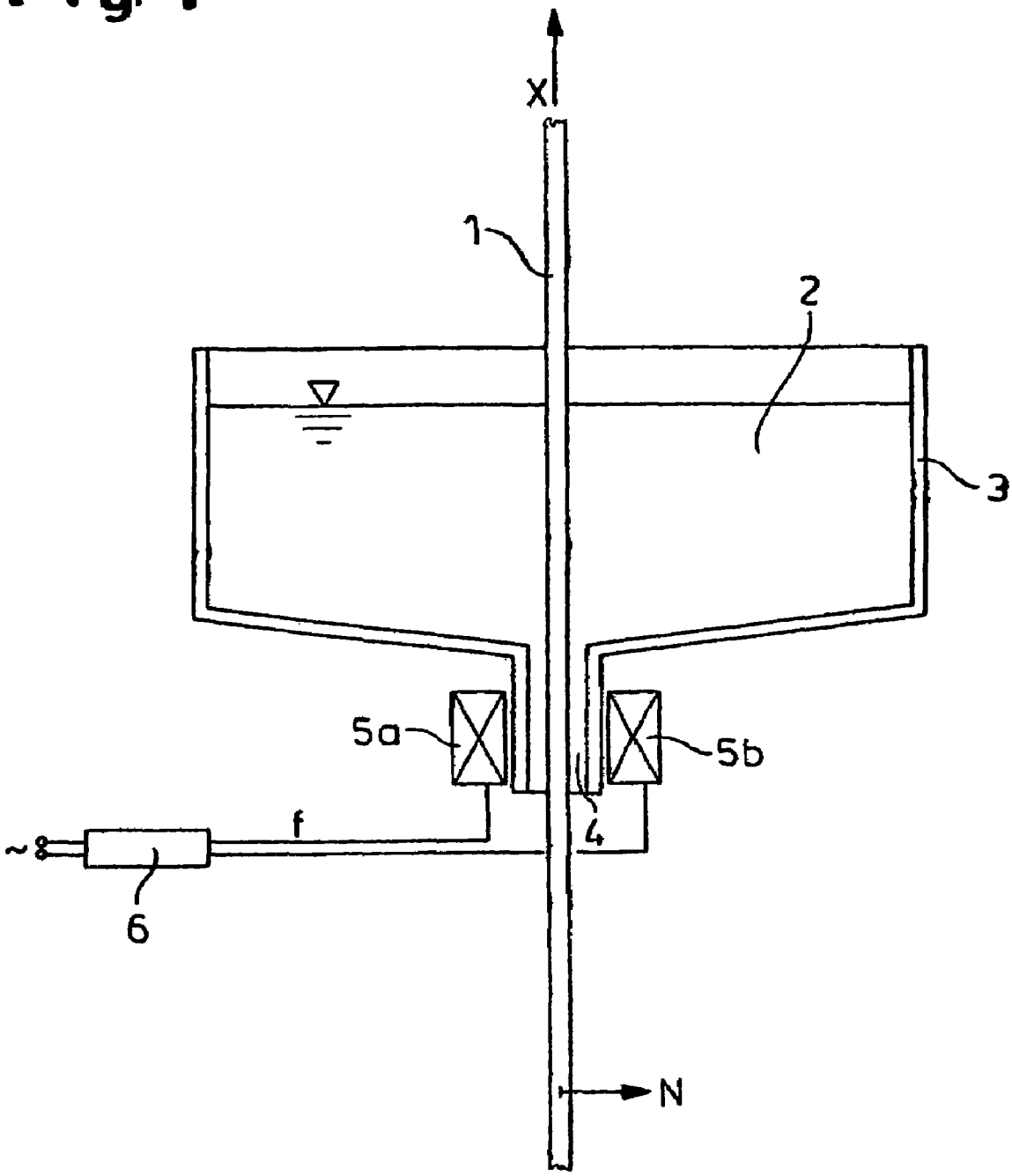
FIG. 1 shows a schematic representation of a hot dip coating tank with a metal strand being guided through it.
Figure 2:
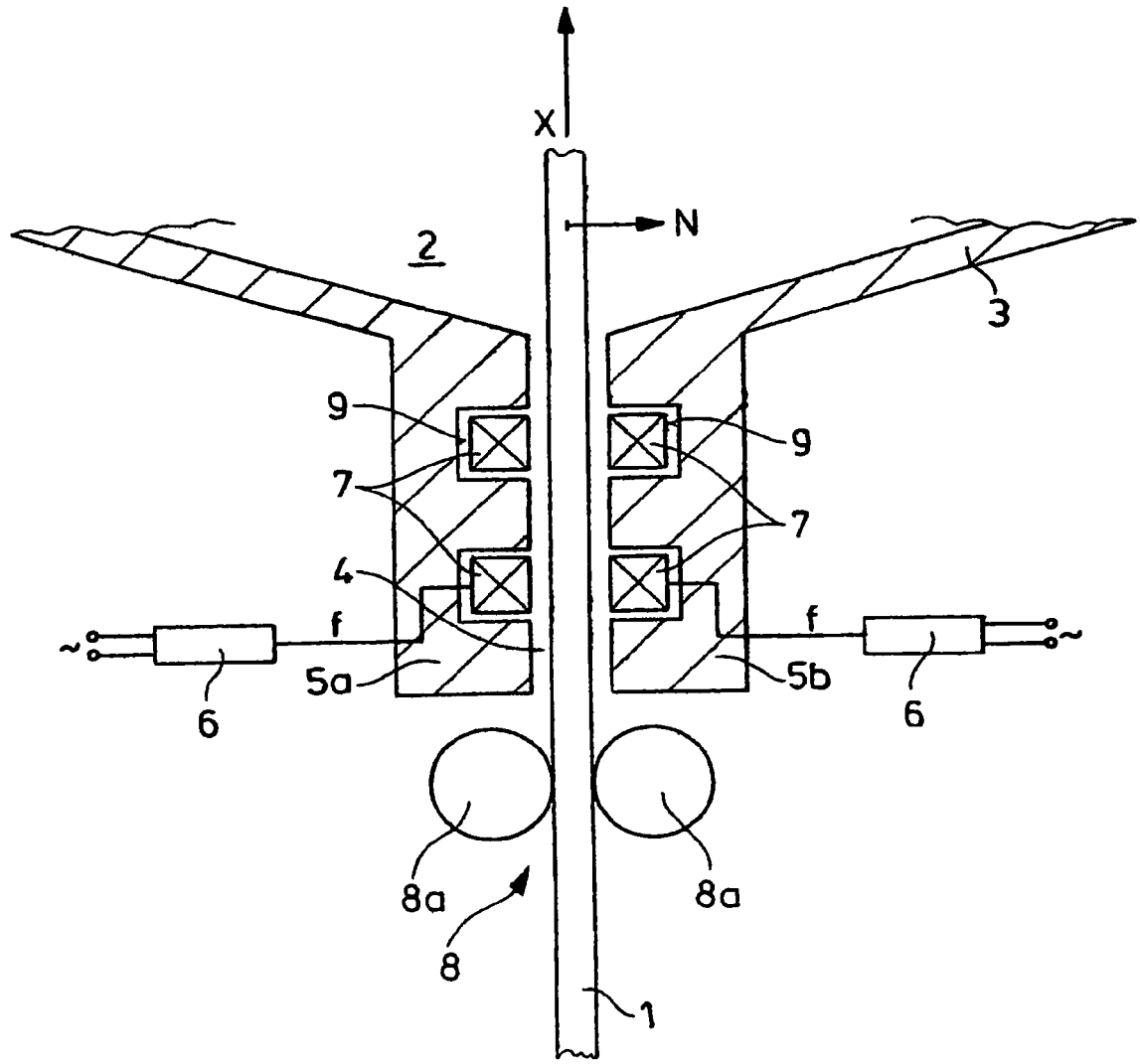
FIG. 2 shows a section through the guide channel and the inductors with guide rollers installed below them.

FIG. 2 shows design details of the region of the guide channel 4. The inductor 5 (or its two halves 5*a* and 5*b*) has grooves 9, in which an induction coil 7 is placed, which is supplied with the alternating current and thus induces the electromagnetic blocking field. Care must be taken to ensure especially that the metal strand 1 is guided as centrally as possible in the guide channel 4 in the direction "N" normal to the strand 1.

DETAILED DESCRIPTION OF THE INVENTION

Since the inductor 5 or the induction coil 7 causes a certain amount of ferromagnetic attraction between the strand 1 and the wall of the guide channel 4 during operation, means 8 for guiding the strand are provided, which in FIG. 2 are designed as guide rollers 8*a*. They are installed below the guide channel 4 and ensure that the metal strand 1 is centrally guided into the guide channel 4.

Figure 3:
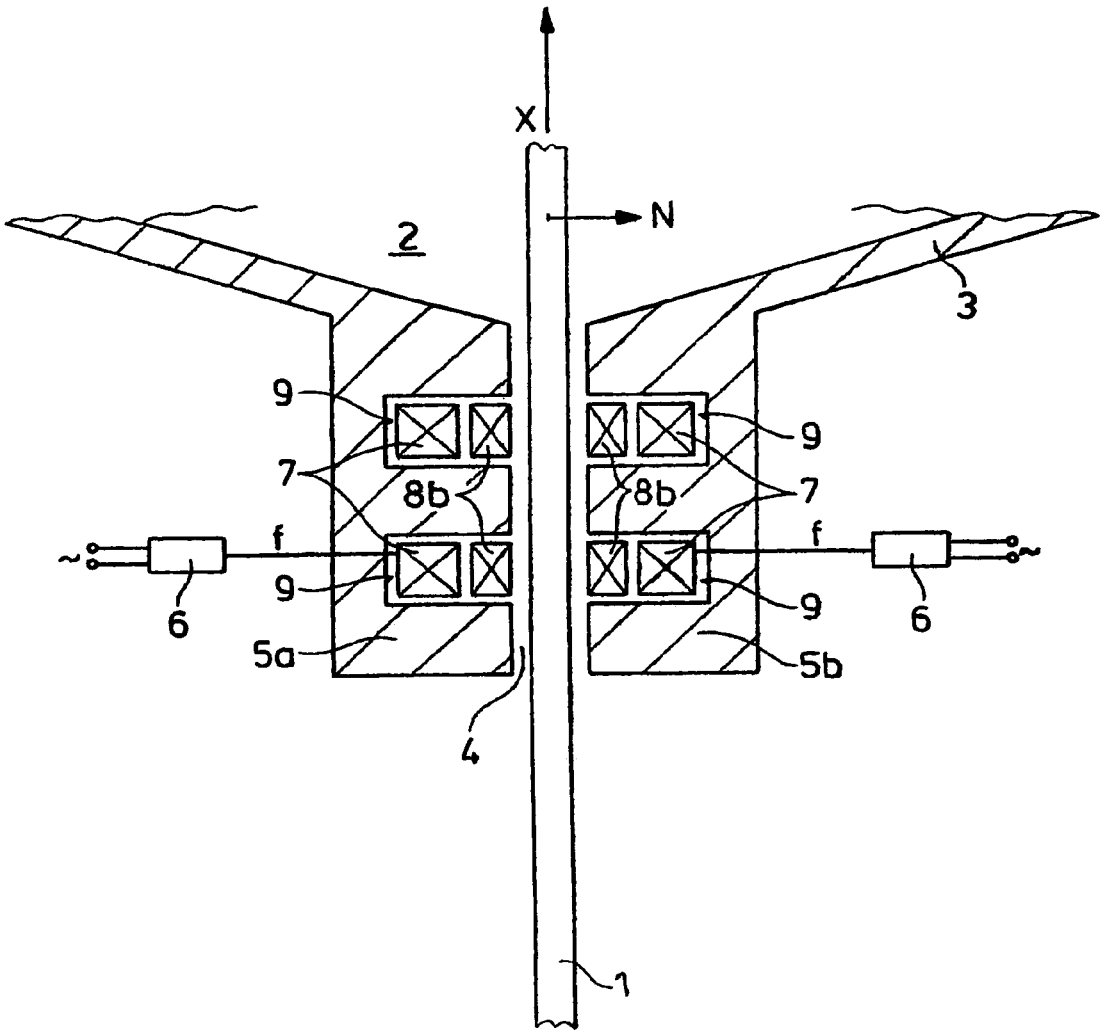
FIG. 3 shows a drawing that corresponds to FIG. 2 with means for guiding the metal strand in the form of correction coils.

As can be seen in FIG. 3, other designs of the means 8 for guiding the strand are also possible. In this case, electric correction coils 8*b* are provided, which induce a controlled magnetic field and in this way maintain the metal strand 1 in a central position in the guide channel 4. As the drawing shows, both the induction coils 7 and the correction coils 8*b* are positioned in the grooves 9 of the inductor 5*a*, 5*b* and at the same height in the direction of movement "X".

Figure 4:
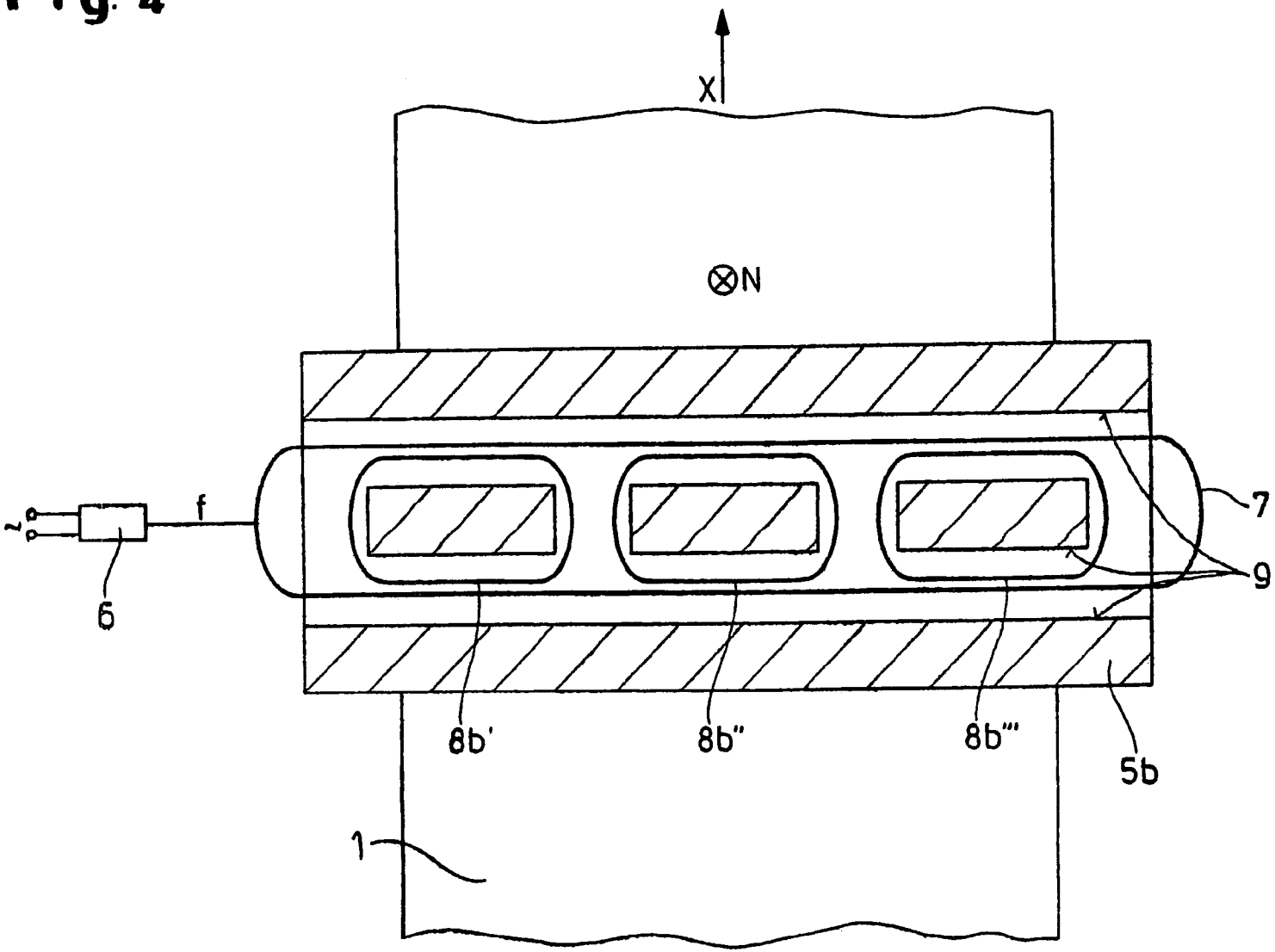
FIG. 4 shows a lateral view of an inductor in accordance with FIG. 3.

FIG. 4 shows a lateral view of one of the inductor halves 5*b*. Here again it can be seen that both the induction coil 7 and the correction coil 8*b* are mounted in the grooves 9 of the inductor 5*b*. The drawing also shows that three correction coils 8*b*', 8*b*", and 8*b*'", which are mounted side by side, are provided in the present case. They act on the metal strand 1 over its whole width and in this way are able to keep it in the middle of the guide channel 4.

The correction coils 8*b*', 8*b*", and 8*b*'" are operated with the same current phase that is present in the induction coil 7, in front of which the correction coils 8*b*', 8*b*", and 8*b*'" are mounted.

It should also be mentioned that a combination of guide rollers 8*a* (see FIG. 2) and correction coils 8*b* (see FIG. 3) can also be used.

LIST OF REFERENCE NUMBERS

1 metal strand (steel strip)
2 coating metal
3 tank
4 guide channel
5, 5*a*, 5*b* electromagnetic inductor
6 electric supply means
7 induction coil
8 means for guiding the metal strand
8*a* guide roller
8*b*, 8*b*', 8*b*", and 8*b*'" correction coil
9 groove
f frequency
X direction of movement
N normal direction

The invention claimed is:

1. Device for the hot dip coating of metal strands (1), said device comprising a tank (3) that contains the molten coating metal (2) and an upstream guide channel (4) such that a metal strand (1) can be guided vertically through the guide channel (4) and the tank (3) in a direction of movement (x) thereby coating the metal strand (1), wherein, in the area of the guide channel (4), an electromagnetic inductor (5) is installed, which can induce induction currents in the coating metal (2) for holding back the coating metal (2) in the tank (3) by means of an electromagnetic blocking field, wherein the induction currents interact with the electromagnetic blocking field to exert an electromagnetic force, wherein the inductor comprised of inductor coils (7) and is (5) is connected to electric supply means (6) that supplies the inductor with alternating current with a frequency (f) that is less than 500 Hz, such that the supply means (6) supplies the inductor (5) with single-phase alternating current, and wherein said device further comprises means (8) for guiding the metal strand (1) in the guide channel (4), which consist of at least two correction coils (8*b*) for controlling the position of the metal strand (1) in the guide channel (4) in the direction (N) normal to the surface of the metal strand (1), wherein the correction coils (8*b*) are arranged at the same height as the induction coils (7), as viewed in the direction of movement (X) of the strand (1).

2. Device in accordance with claim 1, wherein the frequency (f) is less than 100 Hz.

3. Device in accordance with claim 1, wherein at least one of the inductor coils (7) is arranged on either side of the guide channel (4).

4. Device in accordance with claim 1, wherein the inductor (5) has two grooves (9), which run parallel to each other, perpendicular to the direction of movement (X) of the metal strand (1) and perpendicular to the normal direction (N), for holding one of the induction coil (7) and one of the correction coils (8*b*).

5. Device in accordance with claim 4, wherein the correction coils (8*b*), mounted in the grooves (9) is mounted closer to the metal strand (1) than is the induction coils (7).

6. Device in accordance with claim 1, wherein the least two correction are arranged side by side on either side of the metal strand (1).

7. Device according to claim 2, wherein the frequency (f) is 50 Hz.

* * * * *